US010113451B2

(12) United States Patent
Stanhope

(10) Patent No.: US 10,113,451 B2
(45) Date of Patent: Oct. 30, 2018

(54) HYDRAULIC VALVE FOR A CAM PHASER

(71) Applicant: ECO Holding 1 GmbH, Marktheidenfeld (DE)

(72) Inventor: Daniel Stanhope, Nunica, MI (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 74 days.

(21) Appl. No.: 15/471,060

(22) Filed: Mar. 28, 2017

(65) Prior Publication Data

US 2018/0283229 A1 Oct. 4, 2018

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426
See application file for complete search history.

(56) References Cited

U.S. PATENT DOCUMENTS 8,662,040 B2 3/2014 Knecht et al.
2009/0159024 A1* 6/2009 Paul ..... F01L 1/34409 123/90.15
2014/0311333 A1 10/2014 Hutzelmann et al.
2014/0311594 A1 10/2014 Hutzelmann et al.

FOREIGN PATENT DOCUMENTS

DE 102013104573 A1 11/2014
DE 102013104575 A1 11/2014

* cited by examiner

*Primary Examiner* — Zelalem Eshete
(74) *Attorney, Agent, or Firm* — Von Rohrscheidt Patents

(57) ABSTRACT

A hydraulic valve for a cam phaser and including a housing; a hollow cylindrical piston which is supported axially movable in a central opening extending along a longitudinal axis of the housing; a supply connection feeding a hydraulic fluid; and at least a first operating connection, a second operating connection and a tank connection, wherein one of the first operating connection or the second operating connection is connectable through an interior space of the piston with the supply connection and another of the first operating connection or the second operating connection is connectable with the tank connection as a function of a position of a position of the piston along the longitudinal axis of the housing, wherein the piston includes a first flow through opening and a second flow through opening connecting the interior space of the piston with the first operating connection and the second operating connection.

14 Claims, 8 Drawing Sheets

HYDRAULIC VALVE FOR A CAM PHASER

FIELD OF THE INVENTION

The invention relates to a hydraulic valve for a cam phaser.

BACKGROUND OF THE INVENTION

Hydraulic valves for cam phasers for internal combustion engines are well known. The hydraulic valve includes a piston that is axially movable in a housing of a hydraulic valve and controls a hydraulic loading of the cam phaser. Hydraulic valves come in different configurations. The housing is configured hollow cylindrical. The piston is also configured hollow cylindrical. Controlling the cam phaser is performed hydraulically according to a position of a flowable piston and a corresponding opening or closing of connections configured at the housing.

The publication documents DE 10 2013 104 573 A1 and DE 10 2013 104 575 A1 disclose a hydraulic valve which includes a supply connection at a housing end so that a direct flow exposure of the piston received in the housing and thus a straight line loading of the piston with hydraulic fluid supplied through the supply connection is facilitated. The piston has a complex external geometry so that a back flowing into the piston from the operating connections is avoided.

From the publication documents US 2014/0311333 A1 and US 2014/0311594 A1 a hydraulic valve is known which includes check valves that are configured at a circumference of the piston. This requires either a complex housing configuration for receiving and securing the check valves or the housing is configured in several components and requires complex assembly. The piston is configured in plural components and the individual components have to be joined concentrical which requires complex assembly in order to prevent axial misalignment when the components are pressed together.

Another hydraulic valves which includes two respective connection openings for each consumer connection is disclosed in the patent document U.S. Pat. No. 8,662,040 B2. Due to a high number of connection openings the hydraulic valve is rather long.

BRIEF SUMMARY OF THE INVENTION

It is an object of the instant invention to provide a hydraulic valve for a cam phaser wherein the hydraulic valve operates reliably and has low production cost.

The object is achieved by a hydraulic valve for a cam phaser, the hydraulic valve including a housing; a hollow cylindrical piston which is supported axially movable in a central opening extending along a longitudinal axis of the housing; a supply connection feeding a hydraulic fluid; and at least a first operating connection, a second operating connection and a tank connection, wherein one of the first operating connection or the second operating connection is connectable through an interior space of the piston with the supply connection and another of the first operating connection or the second operating connection is connectable with the tank connection as a function of a position of a position of the piston along the longitudinal axis of the housing, wherein the piston includes a first flow through opening and a second flow through opening connecting the interior space of the piston with the first operating connection and the second operating connection, wherein the first flow through opening is associated with the first operating connection and the second flow through opening is associated with the second operating connection, wherein the piston includes a third flow through opening arranged between the first flow through opening and the second flow through opening, wherein the third flow through opening is configured for hydraulic fluid to flow from the first operating connection into the interior space of the piston and from the second operating connection into the interior space of the piston, and wherein the third flow through opening is closable by a check valve arranged in the interior space of the piston to stop a flow of the hydraulic fluid from the interior space of the piston to the first operating connection and the second operating connection.

Advantageous embodiments with useful and non-trivial variations of the invention can be derived from the respective dependent claims.

The hydraulic valve according to the invention for a cam phaser includes a housing and a hollow cylindrical piston which is provided axially movable in a central opening extending along a longitudinal axis of the housing. Furthermore the hydraulic valve includes a supply connection for feeding hydraulic fluid and at least a first and a second operating connection and a tank connection wherein according to a positioning of the piston one of the operating connections is connectable through an interior of the piston with the supply connection and the other operating connection is connectable with the tank connection. In order to connect the inner space with the operating connections the piston includes flow through openings wherein a first flow through opening is associated with the first operating connection and a second flow through opening is associated with the second operating connection and wherein the piston includes a third flow through opening between the first and the second flow through opening wherein the third flow through opening is configured to be flowed through by hydraulic fluid from the first operating connection into the interior space and also to be flowed through with hydraulic fluid from the second operating connection into the interior space and wherein the third flow through opening is closable by a check valve arranged in the interior space in order to avoid a flow through of the hydraulic fluid from the interior space in a direction towards the operating connections.

Thus, the check valve is provided to prevent a hydraulic fluid flow from the interior in a direction towards the operating connections and to simultaneously conduct hydraulic fluid at high pressures resulting from the cam shaft torques from a pressure cavity that is to be emptied into a pressure cavity that is to be filled.

Using the third flow through opening from the first operating connection as well as from the second operating connection provides the option that to provide a piston that is compact or put differently which has a short longitudinal extension. This provides a piston with reduced material cost and minimized installation space for a hydraulic valve that requires a minimum installation space.

Joint use of the third flow through opening is exclusively provided for flowing hydraulic fluid from the pressure reducing consumer into the pressure building consumer. It is another advantage of the third flow through opening that the hydraulic fluid from the pressure reducing consumer is not exclusively run into a tank drain of the hydraulic valve but run into the pressure building consumer in order to accelerate a pressure build up. Thus, a quicker filling of the pressure building consumer is implemented and thus a reaction time of the cam phaser is reduced.

The arrangement of the check valve in the interior of the piston provides a piston whose external geometry is producible at low cost wherein the check valve prevents an unintentional overflow of the hydraulic fluid.

In an embodiment of the piston according to the invention a fixation element is provided to fixate the check valve that opens in a direction towards the interior space. Using the fixation element substantially limits the check valve with respect to its axial movability, but the check valve can move sufficiently for opening and closing the respective flow through opening. Furthermore the fixation element avoids a complex internal geometry of the piston which would otherwise be required in order to fixate the check valve. Since the check valve is received in an interior of the piston and fixated using the fixation element the piston can be produced in one piece. Thus, a cost effective fabrication of the piston is implemented since complex assembly of the piston is not required.

In an economical embodiment of the piston according to the invention, the check valve is configured as a band shaped check valve. This is a cambered metal band which includes overlapping ends so that a back flow of hydraulic fluid over the ends of the band that are offset from each other is prevented.

In another embodiment the fixation element is configured disc shaped. This means put differently that it is configured flat at least in one viewing plane. Thus, a fixation element is provided which impedes a free flow of the hydraulic fluid in the interior space of the piston not at all or by a negligible amount.

In another embodiment of the piston the fixation element is configured flowable so that an improved unimpeded flow of the hydraulic fluid is facilitated since the hydraulic fluid can flow through the fixation element.

Advantageously the fixation element is configured in two components wherein a first component is configured to limit a movement of the check valve and a second component is configured to safely position the first component. Thus, additional influence can be imparted upon the free flow of the hydraulic fluid in the interior of the piston since for example the second portion of the fixation element does not have to provide any movement limitation and can thus have much smaller dimensions than the first portion of the fixation element.

In order to facilitate an insertion of the fixation element into the piston during assembly the fixation element includes at least one contact surface that is in contact with an interior wall of the piston wherein the contact surface includes a beveled and/or outward cambered edge surface. This substantially facilitates inserting the fixation element.

In order to avoid flow separation the fixation element includes at least one rounded outer surface, wherein the outer surface is flowable by the hydraulic fluid. Advantageously outer surfaces of the first portion and of the second portion that are flowable by the hydraulic fluid are provided with beveled outer surfaces.

In another embodiment a height of the portion of the fixation element which is provided for supporting the fixation element corresponds to at least one diameter of the inner cavity. Thus, the fixation element can be fixated in a cost effective manner through friction of the components that are in contact with each other due to their identical size. A cost effective fixation is also implemented when the fixation element has a larger size relative to the diameter since a press fit can be provided.

In order to implement movability of the check valve in a simple manner the portion of the fixation element which is provided for limiting the movement of the check valve has a portion height which is smaller than a height of the portion of the fixation element which is provided for supporting the fixation element. Thus, a movement space is configured between the inner wall and the portion of the fixation element which is provided for a movement limitation of the check valve, wherein the check valve can move within the movement space according to its loading.

In order to produce a flowable connection between the operating connections and a third connection opening which is provided in the housing and which is flow connectable with a tank connection of the hydraulic valve, the piston includes a flow out channel. The flow out channel can be positioned in the piston so that the flow out channel is arranged to facilitate an inflow of hydraulic fluid in particular from the consumer connections in the portion of the third flow through opening that is connected with the two consumer connections. This has the advantage that the hydraulic valve that is configured with the piston according to the invention only includes a single tank drain which implements reduced oil leakage losses.

In an alternative embodiment the housing of the hydraulic valve includes the flow out channel for providing a flowable connection between the operating connections and the third connection opening provided in the housing which third connection opening is flow connectable with the tank connection of the hydraulic valve. It is an advantage of configuring the flow out channel in the housing that the tank connection can be flow connected with the housing at different locations. This means put differently that the tank connection does not have to be arranged in the portion of a piston end that is oriented towards the supply channel like for a flow out channel that is configured in the piston but the tank connection can be adapted to the connection requirements. In particular the tank drain can be provided at an end of the hydraulic valve that is arranged opposite to the supply connection. Another advantage is provided since the hydraulic valve according to the invention only includes a single tank connection which provides reduced oil leakage losses.

The hydraulic valve according to the invention can be configured rather short and thus installation space optimized which also provides a reduced weight of the hydraulic valve in addition to small installation space requirement.

Another advantage is the flexibility to modify flow through openings relative to a piston travel. Thus, for known hydraulic valves which have at least two connection openings the number of the connection openings can be reduced to one connection opening per operating connection. The reason is that the hydraulic valve according to the invention has a check valve that is movable with the piston since the check valve is received in an interior of the piston and thus moves relative to the connection openings, whereas the check valves of a known hydraulic valve are fixated in the housing.

Another advantage is provided in that the hydraulic valve according to the invention only includes one single tank connection through which hydraulic fluid runs back into the tank drain when one of the pressure cavities is pressure relieved. This is caused by the third flow through opening that is used by the two operating connections and that is flow connected with the tank connection. When for example the piston includes the flow out channel the flow out channel can be positioned in the piston so that the flow out channel is arranged to provide an inflow of hydraulic fluid in particular from the consumer connections in the portion of the third flow through opening with which the two consumer connections communicate. This has the advantage that the hydraulic valve provided with the piston according to the invention only includes a single tank drain which provides reduced oil leakage losses.

Furthermore the piston of the hydraulic valve according to the invention can be used for different variants of the hydraulic valve due to its external geometry that is simple to produce, so that expensive development work can be avoided. Thus, the hydraulic valve is simple to produce.

In an embodiment of the hydraulic valve according to the invention the supply connection is arranged at a first end of the tubular housing so that the piston is flowable directly and without a loss inducing flow deviation. This improves a reaction time or a reaction speed of the cam phaser.

BRIEF DESCRIPTION OF THE DRAWINGS

Further advantages and detail of the invention can be derived from the subsequent description of advantageous embodiments and from the drawing figures. The features and feature combinations recited supra in the description and recited in the subsequent figure description and/or features and feature combinations only shown in the drawings are not only usable in the respectively cited combination but also in other combinations or by themselves without departing from the spirit and scope of the invention. Identical or functionally equivalent elements are provided with identical reference numerals. For the purpose of clarity it is possible that the elements are not provided with reference numerals in all figures without losing their association, wherein.

DETAILED DESCRIPTION OF THE INVENTION

Figure 1:
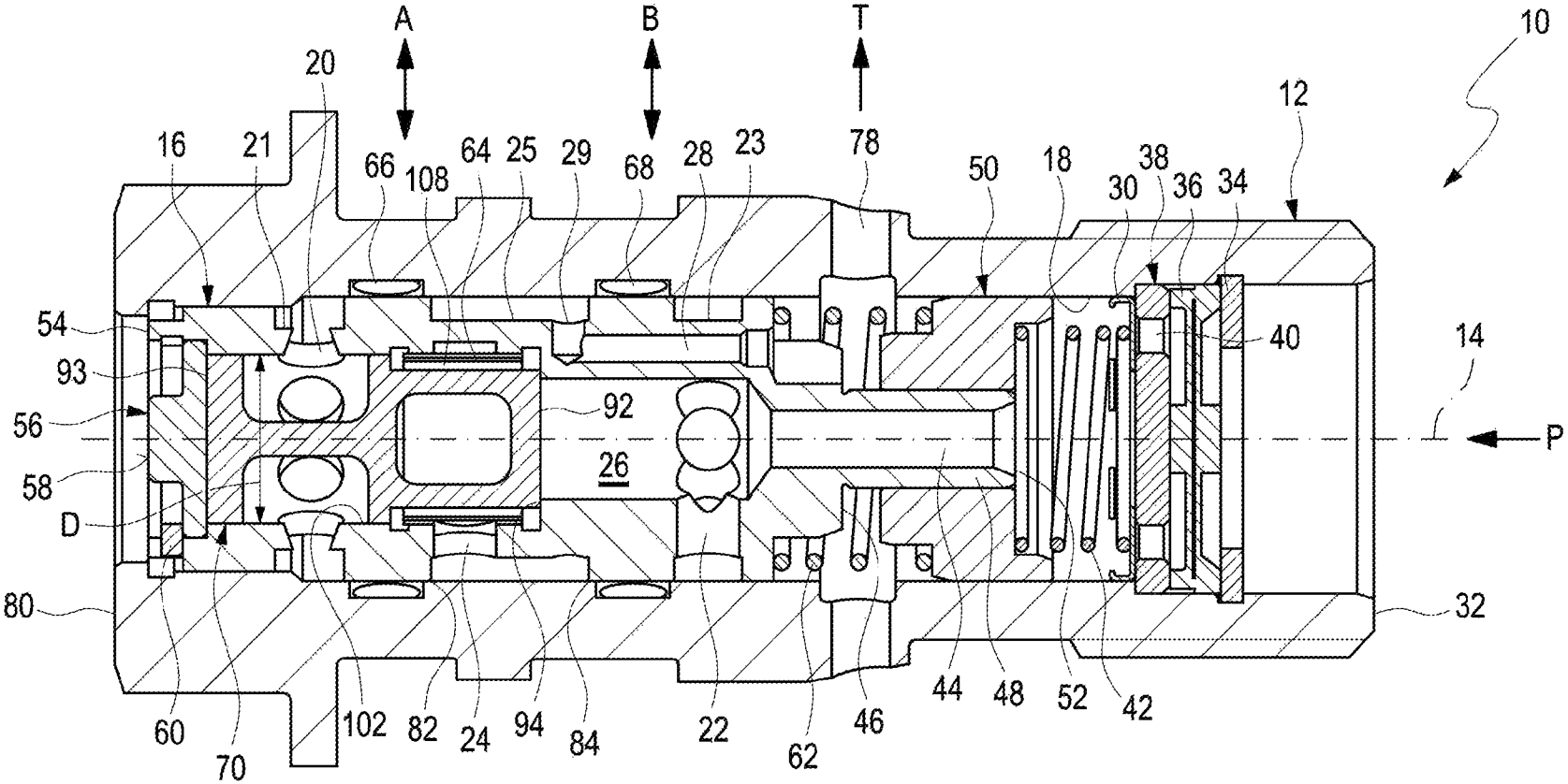
FIG. 1 illustrates a longitudinal sectional view of a hydraulic valve according to the invention for a cam phaser in a first embodiment.

A hydraulic valve 10 according to the invention for a phaser that is not illustrated in more detail of a cam shaft that is not illustrated in more detail is configured according to FIG. 1 in a first embodiment. The hydraulic valve 10 is configured to be received as a central valve in a rotor of the cam phaser that is not illustrated in more detail. This means put differently that the hydraulic valve 10 is received in a central opening of the cam phaser and at least partially enveloped by the cam phaser.

The hydraulic valve 10 includes a housing 12 which is configured flowable. In order to hydraulically supply the cam phaser plural connections A, B, P, T are provided at the housing 12. In the housing 12 a piston 16 that is axially movable in a central opening of the housing 12 is received and axially movable along a longitudinal axis of the hydraulic valve 10. The housing 12 is configured substantially tubular. The cam phaser facilitates a change of opening and closing times of the internal combustion engine during an operation of the internal combustion engine that is not shown in more detail. Thus, the cam phaser continuously adapts a relative angular position of a cam shaft of the internal combustion engine that is not illustrated in more detail relative to a crank shaft of the internal combustion engine that is not illustrated in more detail, wherein the cam shaft is rotated relative to the crank shaft. The relative rotation of the cam shaft moves the opening and closing times of the gas control valves so that the internal combustion engine delivers an optimum power at a respective speed.

A stator of the cam phaser that is not illustrated in more detail is connected torque proof with a drive gear of the cam shaft that is not illustrated in more detail. At insides of a stator base element radially inward extending bars are configured in uniform intervals so that an intermediary space is formed respectively between two adjacent bars. A blade that is not illustrated in more detail of a rotor hub of the rotor that is not illustrated in more detail is arranged so that it protrudes into the intermediary space. Corresponding to the number of the intermediary spaces the rotor hub has a number of blades, thus the blades divide each intermediary space into two pressure cavities. A pressure medium, typically a hydraulic fluid is introduced into these partial spaces in a controlled manner by the hydraulic valve 10.

A pressure cavity is associated with each operating connection A, B. Thus the first pressure cavity is associated with the first operating connection A and the second pressure cavity is associated with the second operating connection B. In order to connect with the pressure cavities the first operating connection A includes a first connection opening 66 configured in the housing 12 and the second operating connection B includes a second connection opening 68 configured in the housing 12. In order to change an angular position between the cam shaft and the crank shaft the pressure medium in the first pressure cavity or in the second pressure cavity is pressurized while the second pressure cavity or the first pressure cavity is unloaded. The unloading is performed through the tank connection T wherein the hydraulic fluid can drain through the tank connection T.

The hydraulic valve 10 according to the invention is depicted in FIG. 1 in a longitudinal sectional view. The piston 16 is configured hollow cylindrical and includes a first flow through opening 20, a second flow through opening 22 and a third flow through opening 24. Each flow through opening 20, 22 and 24 includes at least one, advantageously two radial piston bore holes. The first flow through opening 20 is associated with the first operating connection A, the second flow through opening 22 is associated with the second operating connection B and the third flow through opening 24 is configured as a function of a positioning of the piston 16 to provide a flow connection of the first operating connection A or the second operating connection B with the inner space 26 in order to use cam shaft torques from the pressure cavity that is to be emptied to fill the pressure cavity that is to be filled more quickly as will be described infra.

In order for the hydraulic fluid to flow out of the hydraulic valve 10 through the tank connection T into a provided tank that is not illustrated in more detail the hydraulic valve 10 includes a flow out channel 28 which extends in the first embodiment substantially in a direction of the longitudinal axis 14 in the piston 16.

A return flow of the fluid into the supply connection P is prevented by a first check valve 30 which is arranged in a portion of a first end 32 of the housing 12 at which the central opening 18 is flow connected with the supply connection P downstream of a fluid filter that is positioned in the housing 12 using a safety element 34 to secure the fluid filter in position. Between the first check valve 30 which is configured as an annular check valve and the fluid filter 36 a flow disc 38 is received in the housing 12 whose disc opening 40 are closeable by the first check valve 30 and through which hydraulic fluid moves from the supply connection P into the hydraulic valve 10.

The first check valve 30 is pressure loaded by the first tension element 42 in a direction towards the flow disc 38. This means put differently the check valve is pressed against the flow disc 38 by the first preload element 42 in order to close the disc openings 40. As soon as the hydraulic fluid flowing through the supply connection P has a pressure which is greater than a preload force of the first preload element 42 the first check valve 30 lifts off from the flow disc 38 and the hydraulic fluid enters through the disc openings 40 into an inlet channel 44 of the piston 16 that is flow connected with the inner cavity 26.

In order to arrest and support the piston 16 the piston includes a pinion shaped support element 48 at a first piston end 46 which pinion shaped support element at least partially includes the inlet channel 44. The support element 48 engages an arresting cover 50 and is received therein, wherein the arresting cover is used for calibrating the hydraulic valve 10 in addition to arresting and supporting the guide element 48. Furthermore the arresting cover 50 is used for supporting the first preload element 42 at a side that is oriented away from the first check valve 30. The support element 48 is arranged so that it engages a central cover opening 42 of the arresting cover 50.

The piston 16 is operatively connected with an actuator that is not illustrated in more detail at a second piston end 54 that is oriented away from the first piston end 46. At the second piston end 54 a piston cover 56 is positioned which closes the inner cavity 26 against an outflow of the fluid. Furthermore an actuator plunger that is not illustrated in more detail can engage the piston cover 56 at a cover surface 58 that is configured oriented away from the inner cavity 26 so that the piston 16 is positioned in the central opening 18 using the actuator 16. The piston cover 56 is fixated in the housing 12 using an additional safety element 60.

In order to safely position the piston 16 a second preload element 62 is provided which is arranged between the piston 16 and the arrester cover 50 in the central opening 18.

The hydraulic valve 10 according to the invention includes a second check valve 64 to secure the third flow through opening 24 against an outflow of hydraulic fluid from the inner space 26 in a direction towards the operating connections A, B.

In order to direct the fluid and secure the position of the second check valve 64 a fixation element 70 is arranged in the housing 12 so that it fixates the second check valve 64.

Figure 2:
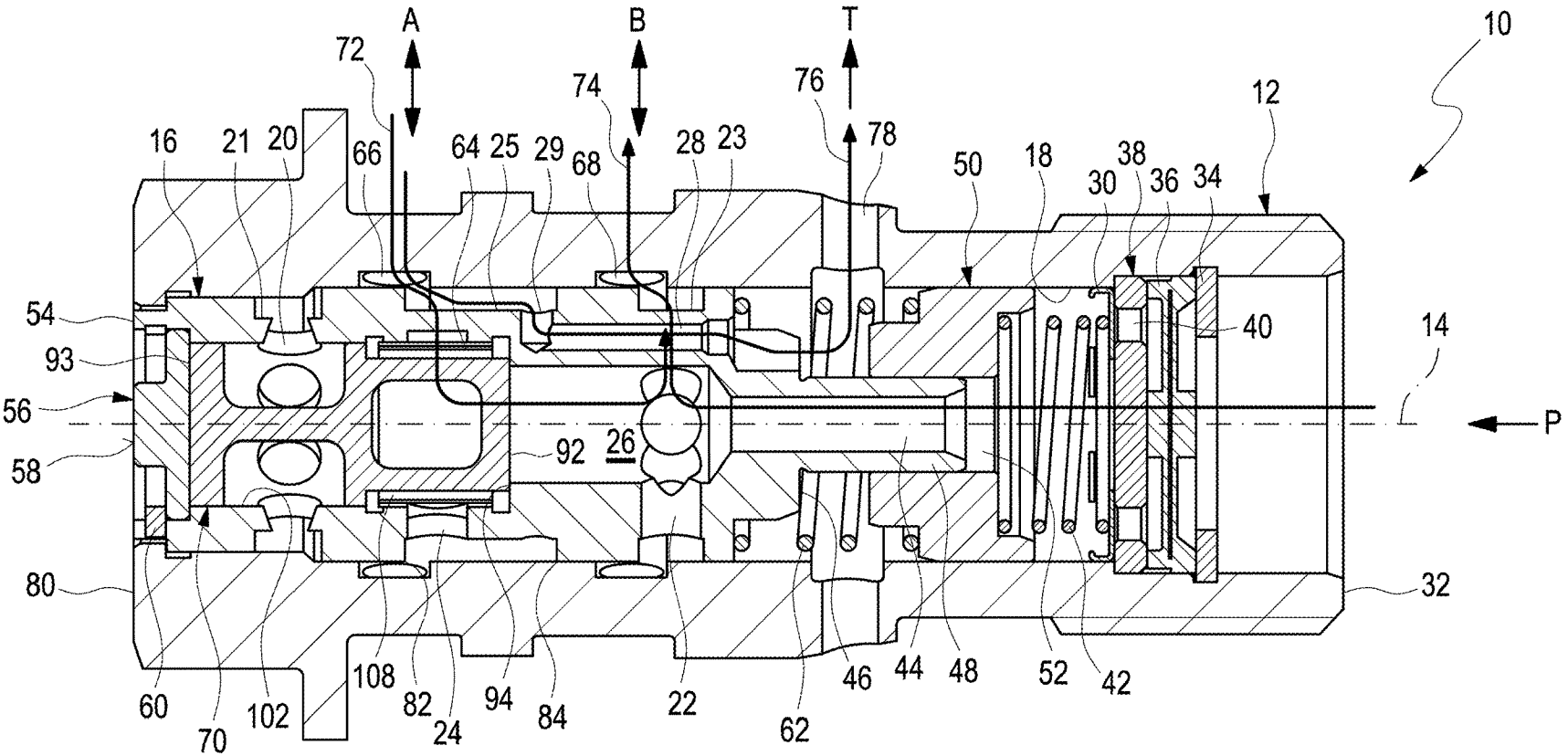
FIG. 2 illustrates a longitudinal sectional view of the hydraulic valve according to FIG. 1 in a first position.

FIG. 2 illustrates a longitudinal sectional view of the hydraulic valve 10 according to FIG. 1 in a first position wherein flow through directions of the hydraulic fluid are indicated by flow lines 72, 74, and 76 in this first position. The second opening connection B is connected through the inner cavity 26, the second flow through opening 22 and the second connection opening 68 with the supply connection P as illustrated by the second flow line 74. Additionally pressure is feedable under the occurring cam shaft torques in the pressure cavity associated with the first operating connection A starting from the first operating connection A through the third flow through opening 24 and the inner space 26 in the second operating connection B, as soon as the second check valve 64 is opened due to the pressure of the cam shaft torques as illustrated by the first flow line 72.

Since the hydraulic fluid can flow from the first operating connection A at least partially into the second operating connection B a reaction time of filling the pressure cavity associated with the operating connection B can be significantly reduced. Furthermore starting from the first operating connection A, hydraulic fluid flows through the flow out channel 28 into a third connection opening 78 configured in the housing 12 which is flow connected with the tank connection T as illustrated by the third flow line 76.

The flow through openings 20, 22 and 24 are respectively configured in a ring groove 21, 23 and 25, wherein the first flow through opening 20 is associated with the first ring groove 21, the second flow through opening 22 is associated with the second ring groove 23 and the third flow through opening 24 is associated with the third ring groove 25. The ring grooves 21, 23 and 25 form control edges which cause an opening and/or closing of the connection openings 66, 67, and 68.

The flow out channel 28 is flow connected with the third ring groove 25 which includes a first control edge 82 and a second control edge 84. The first control edge 82 releases the first connection opening 66 whereas the second control edge 84 blocks the second connection opening 68. Thus, hydraulic fluid can flow from the first operating connection A through the third ring groove 25 into the flow out channel 28 which is flow connected with the third connection opening 78.

Figure 3:
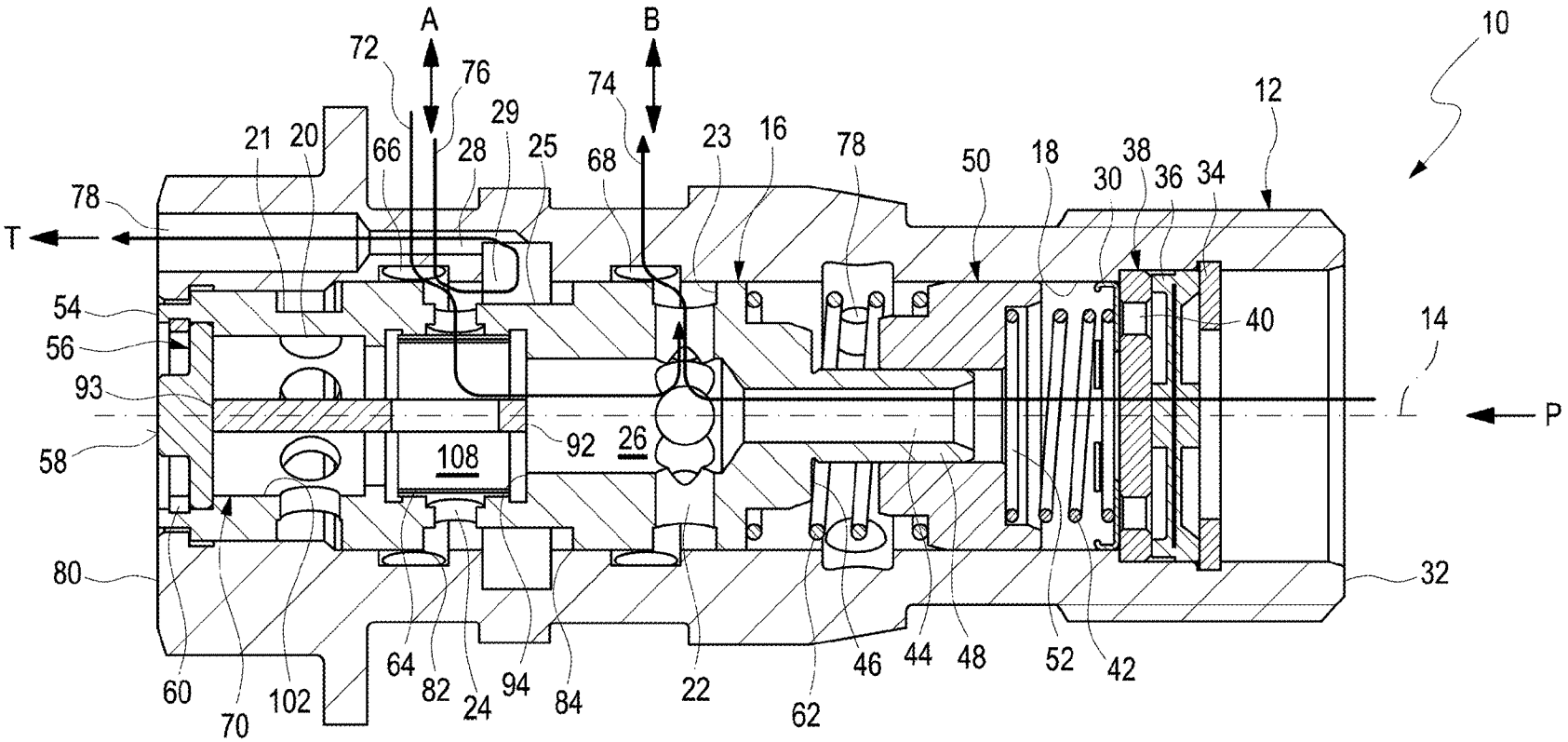
FIG. 3 illustrates a longitudinal sectional view of the hydraulic valve according to the invention in a second embodiment in the first position.

FIG. 3 illustrates a longitudinal sectional view of the hydraulic valve 10 according to the invention in a second embodiment in the first position. The second embodiment differs from the first embodiment through the arrangement of the flow out channel 28 which is flow connected with the third connection opening 78 which is arranged in the second embodiment at a second end 80 of the housing 12 which is configured oriented away from the first end.

The flow out channel 28 is configured in the second embodiment of the hydraulic valve 10 according to the invention in the housing 12. Between the first connection opening 66 and the second connection opening 68 the flow out channel 28 branches off in the housing 12 so that like in the first embodiment hydraulic fluid can run through the third ring groove 25 into the flow out channel 28. This means put differently that the channel entry 29 of the flow out channel 28 is configured between the first connection opening 66 and the second connection opening 68. Compared therewith the channel entry 29 of the hydraulic valve 10 is configured according to the first embodiment in the piston 16 in the third ring groove 25.

Figure 4:
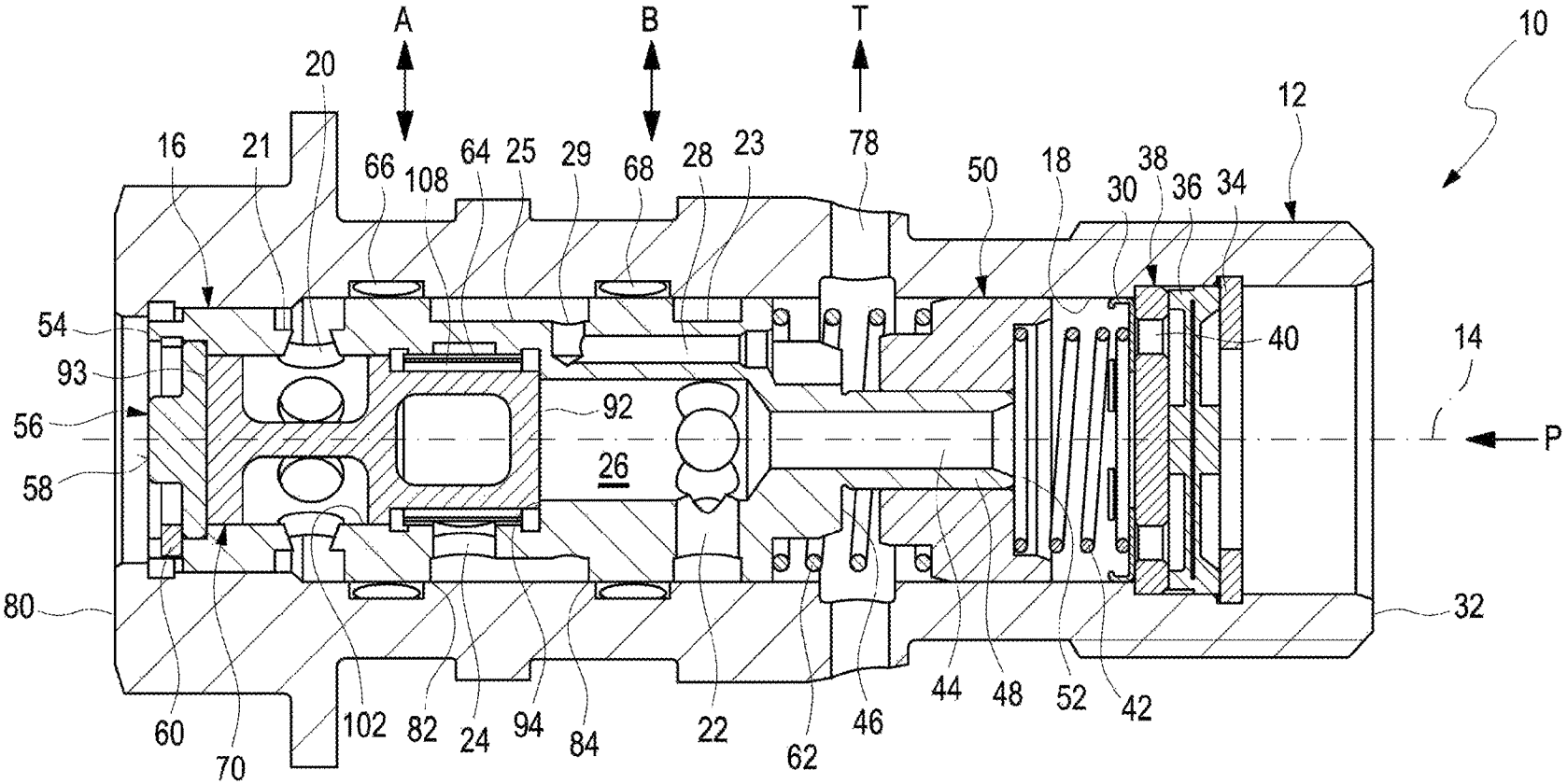
FIG. 4 illustrates a longitudinal sectional view of the hydraulic valve according to FIG. 1 in a second position.
Figure 5:
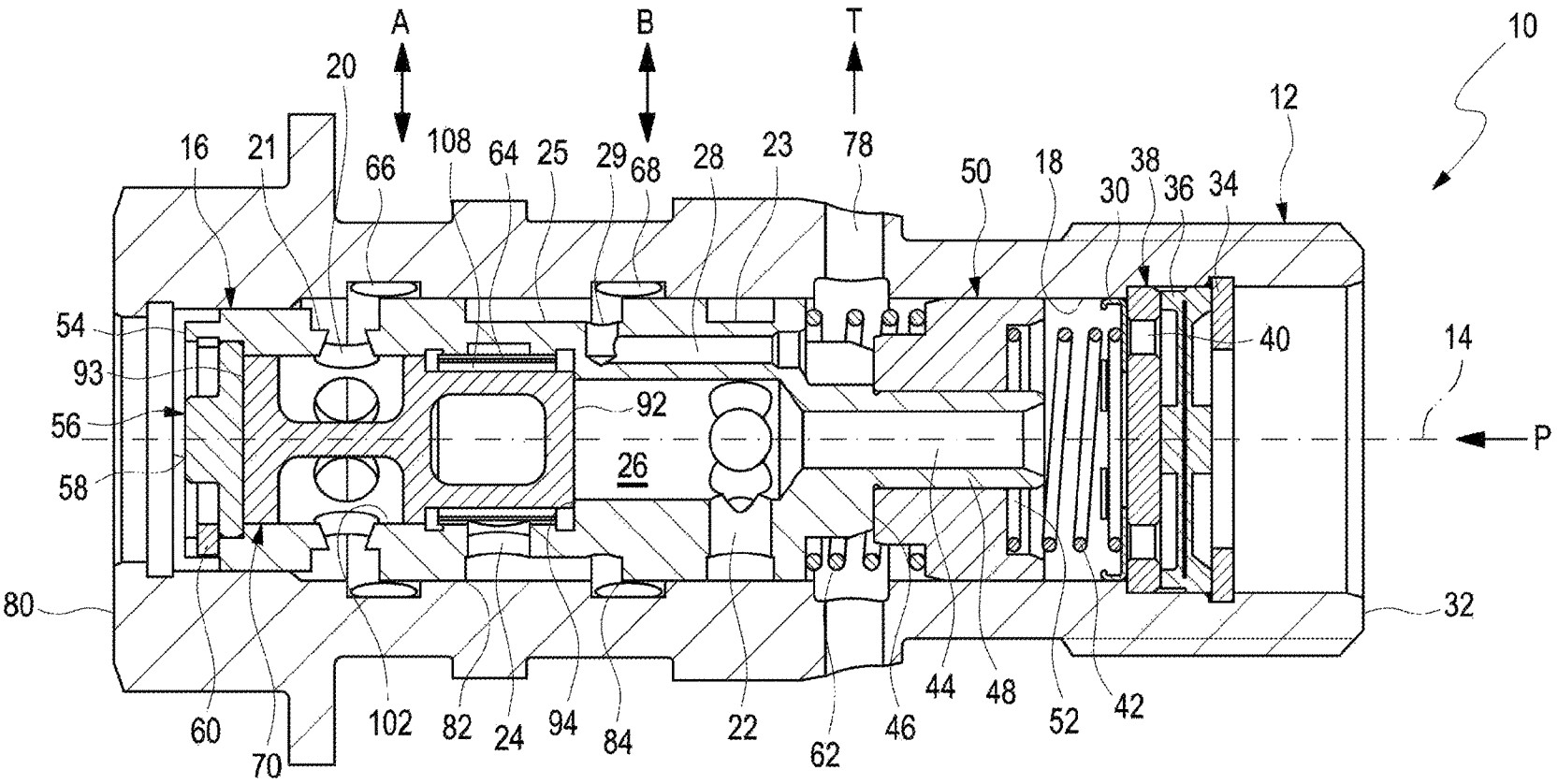
FIG. 5 illustrates a longitudinal sectional view of the hydraulic valve according to FIG. 1 in a third position.

In FIGS. 4 and 5, the hydraulic valve 10 according to the first embodiment is illustrated in two additional positions, a second position and a third position. In FIG. 4 the first connection opening 66 and the second connection opening 68 are closed through respective positioning of the piston 16 and thus using the control edges 82, 84 of the third ring groove.

FIG. 5 illustrates the piston 16 in the third position in which the first operating connection A is connected through the inner space 26, the first flow through opening 20 and the first connection opening 66 with the supply connection P. Additionally hydraulic fluid is feedable at prevailing cam torques in the pressure cavity associated with the second operating connection B starting from the second operating connection B through the third flow through opening 24 and the inner space 26 into the first operating connection A as soon as the second check valve 64 is opened due to the pressure of the cam torques. Furthermore the second operating connection B is connected through the first ring groove 25 with the flow out channel 28 and thus with the tank drain T.

Figure 6:
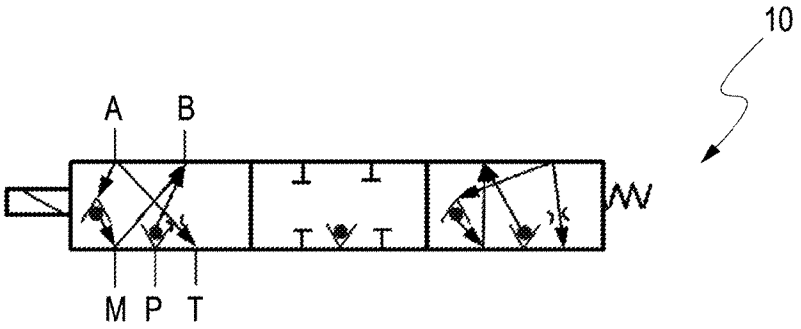
FIG. 6 illustrates a symbolic view of the hydraulic valve.

FIG. 6 illustrates the hydraulic valve 10 according to the invention in a symbolic representation. The left switching position corresponds to the first position of the piston 16 in which hydraulic fluid flows from the first operating connection A into the second operating connection B which is filled with the hydraulic fluid from the supply connection P. The right switching piston corresponds to the third position of the piston 16 in which hydraulic fluid flows from the second operating connection B into the first operating connection A and the first operating connection A is filled with hydraulic fluid from the supply connection P. Also in this third position a reaction time for filling the first pressure cavity associated with the operating connection A is substantially reduced since hydraulic fluid can flow from the second operating connection B at least partially into the first operating connection A.

In the center switching position which corresponds to the second position of the piston 16 as illustrated in FIG. 4 the operating connections A, B are blocked against flow through.

Figure 7:
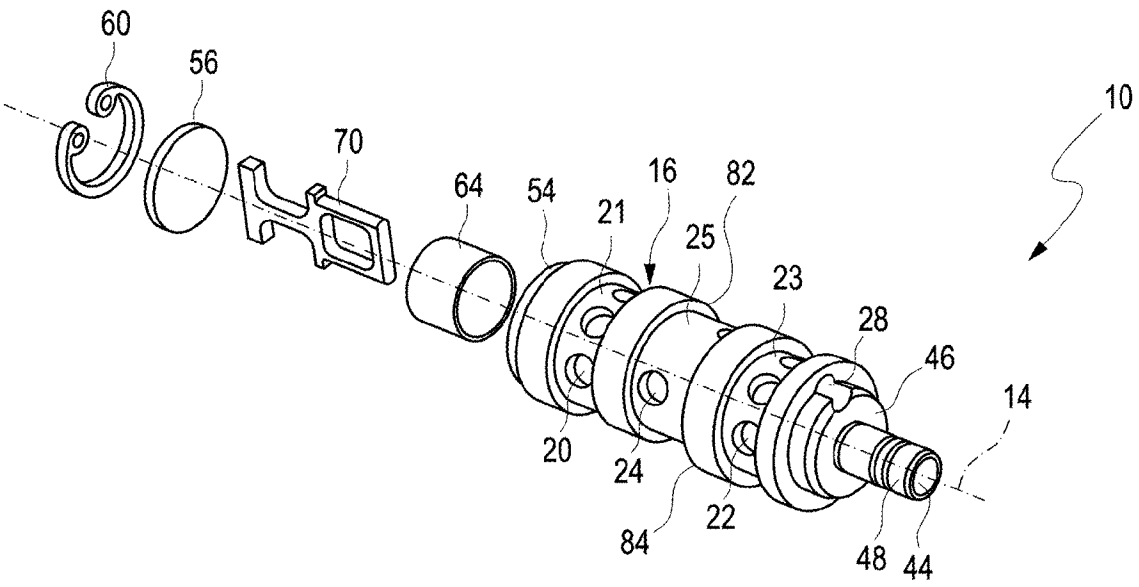
FIG. 7 illustrates an exploded view of the piston according to the invention of the hydraulic valve according to FIG. 1.
Figure 8:
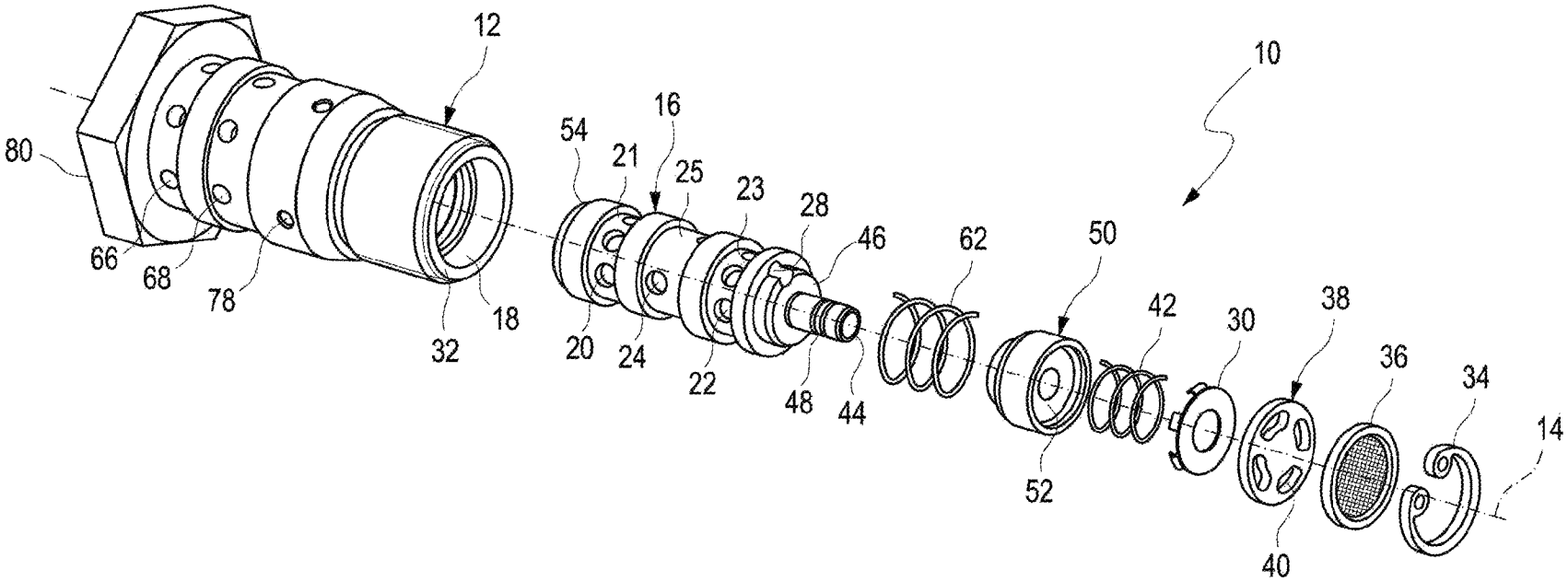
FIG. 8 illustrates an exploded view of the hydraulic valve according to FIG. 1.

To further illustrate the invention FIG. 7 depicts the piston 16 according to the invention of the first embodiment in an exploded view and FIG. 8 depicts the hydraulic valve 10 according to the invention according to the first embodiment also in the exploded view.

The piston 16 according to the invention and accordingly the hydraulic valve 10 according to the invention includes a second check valve 64 in the portion of the third flow through opening 24 in order to prevent a reverse flow of the hydraulic fluid. Put differently this means that the second check valve 64 facilitates a flow of hydraulic fluid from the consumer connections A, B through the third flow through opening 24 into the inner cavity 26 but not vice versa, since the hydraulic fluid presses the second check valve 64 against the third flow through opening 24.

Figure 9:
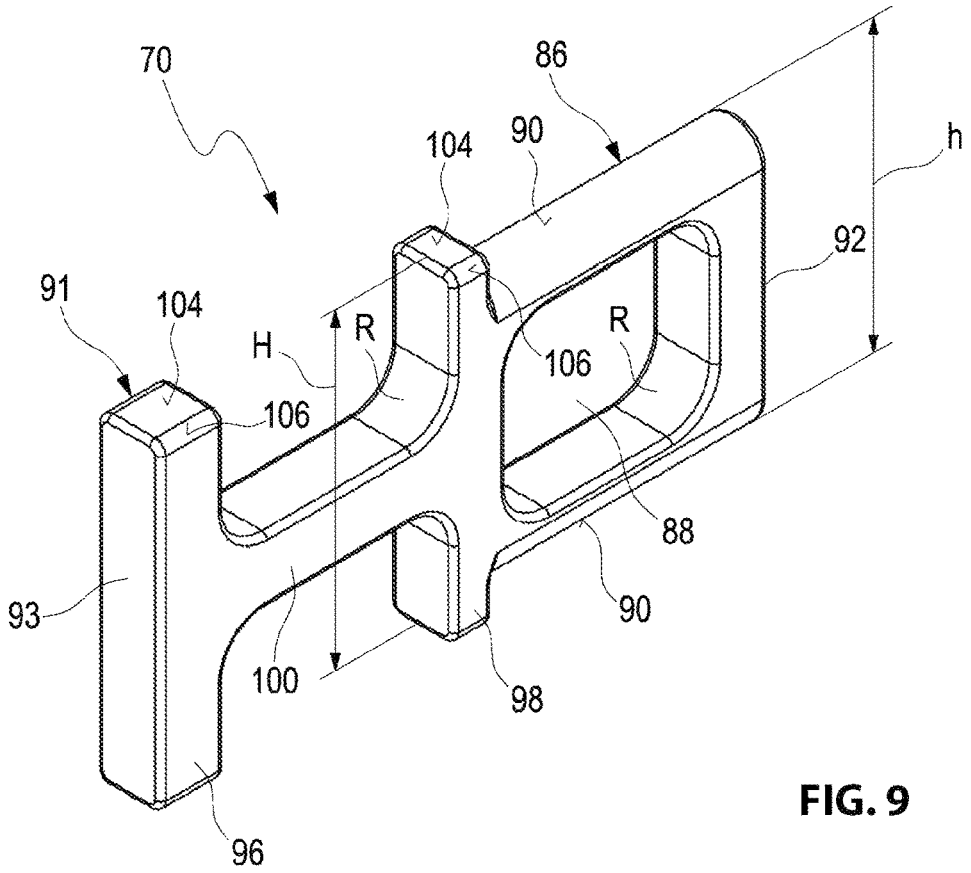
FIG. 9 illustrates a perspective view of a fixation element of the hydraulic valve according to the invention.

The second check valve 64 is positioned by the fixation element 70 in the interior space 26 of the piston 16. The fixation element 70 is illustrated in FIG. 9 in a perspective view. The fixation element is configured to prevent a flow deviation or flow separation of the hydraulic fluid flowing through the piston 16 so that a reaction time of the piston 16 and thus of the cam phaser is not influenced unfavorably.

The fixation element 70 which is configured disc shaped includes a support frame 86 which limits a contraction of the second check valve 64 which is configured band shaped. Thus, it suffices to configure the boundary in a single plane which is achieved by the support frame 86. In order for the flow of the hydraulic fluid to remain unimpeded, the support frame 86 is flowable which is facilitated by a frame opening 88.

The support frame 86 is configured rounded at its outer surfaces 90, so that turbulence of the hydraulic fluid is prevented. In order to safely position the support frame 86 the fixation element 70 includes a double T shaped handle 91 which supports the support frame 86.

Figure 10:
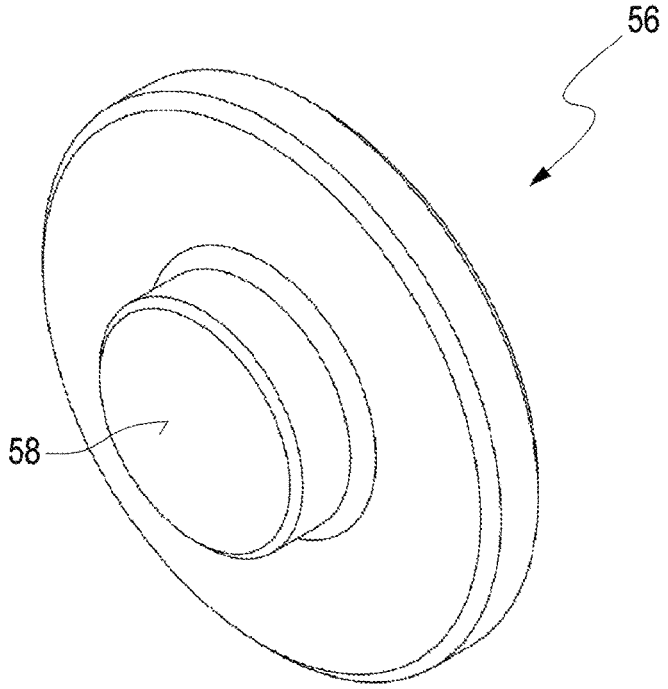
FIG. 10 illustrates a perspective view of a piston cover of a hydraulic valve according to the invention.

The fixation element 70 is supported on one side at a first element end 92 which is oriented towards the first end 32 of the housing 12 at a shoulder 94 formed in an interior 26 of the piston 16, so that the shoulder 94 provides an axial stop during assembly. On the other side the fixation element 70 is supported at its second element end 93 at the piston cover 56 wherein closing the inner space 26 with the piston cover 56 which is illustrated in FIG. 10 in a perspective view wedges and positions the fixation element 70 in the interior space 26. This means put differently that the fixation element 70 is configured in two components, wherein the support frame 86 is provided as a first component for movement limitation of the second check valve 64 and the handle 91 is provided as a second component to safely position the support frame 86.

The handle 91 includes a first transversal beam 96 which is used for support at the piston cover 56 and a second transversal beam 98 connected by a connecting rod 100 of the handle 91 with the first transversal beam 96. The second transversal beam 98 is permanently connected with the support frame 86.

The two transversal beams 96, 98 include a height H extending in a radial direction of the cylindrical inner space 26 wherein the height H corresponds to a diameter D of the section of the inner space 26 in which the fixation element 70 is received.

In order to simplify assembly which includes inserting the fixation element 70 into the inner space 26 starting from the second end 80 of the housing 12 the transversal beams 96, 98 include edge surfaces 106 at contact surfaces 104 oriented towards an inner wall 102 of the piston 16, wherein the edge surfaces are outward cambered and thus convex. By the same token the edge surfaces 106 can also be configured as a bevel.

The edge surfaces 104 are configured complementary to the inner wall 102. This means put differently that the contact surfaces 104 are configured adapted to a camber of the inner wall 102. Thus, the fixation element 70 can be safely inserted into the piston 16 without wedging.

In order to provide mobility for the second check valve 64 a support frame height h is configured smaller than the height H. Thus, a movement space 108 between the support frame 106 and the inner wall 102 is provided in which the second check valve 64 can contract or expand unimpeded.

Overall the fixation element 70 is configured flow optimized by the edge surfaces 106, the cambered contact surfaces 104 and by radii R configured in the frame opening 88 and at transitions between the transversal beams 96, 98 and the connection rod 100 so that a flow separation that is typical at sharp edges is prevented.

What is claimed is:

1. A hydraulic valve for a cam phaser, the hydraulic valve comprising:

a housing;

a hollow cylindrical piston which is supported axially movable in a central opening extending along a longitudinal axis of the housing;

a supply connection feeding a hydraulic fluid; and at least a first operating connection, a second operating connection and a tank connection, wherein one of the first operating connection or the second operating connection is connectable through an interior space of the piston with the supply connection and another of the first operating connection or the second operating connection is connectable with the tank connection as a function of a position of a position of the piston along the longitudinal axis of the housing, wherein the piston includes a first flow through opening and a second flow through opening connecting the interior space of the piston with the first operating connection and the second operating connection, wherein the first flow through opening is associated with the first operating connection and the second flow through opening is associated with the second operating connection, wherein the piston includes a third flow through opening arranged between the first flow through opening and the second flow through opening, wherein the third flow through opening is configured for hydraulic fluid to flow from the first operating connection into the interior space of the piston and from the second operating connection into the interior space of the piston, and wherein the third flow through opening is closable by a check valve arranged in the interior space of the piston to stop a flow of the hydraulic fluid from the interior space of the piston to the first operating connection and the second operating connection.

2. The hydraulic valve according to claim 1, wherein the check valve is fixated by a fixation element.

3. The hydraulic valve according to one of the claim 1, wherein the check valve is configured band shaped.

4. The hydraulic valve according to claim 2, wherein the fixation element is configured disc shaped to provide a movement limitation for the check valve.

5. The hydraulic valve according to claim 2, wherein the fixation element is configured flowable.

6. The hydraulic valve according to claim 2, wherein the fixation element (70) is configured in two components, wherein a first component of the two components is configured to provide a movement limitation of the check valve and a second component of the two components is configured to securely position the first component.

7. The hydraulic valve according to claim 2, wherein the fixation element includes at least one contact surface that is in contact with an inner wall of the piston and which includes a beveled or outward cambered edge surface.

8. The hydraulic valve according to claim 2, wherein the fixation element includes at least one cambered outer surface which is flowable by the hydraulic fluid.

9. The hydraulic valve according to claim 2, wherein a height of a first portion of the fixation element which is provided for supporting the fixation element corresponds at least to a diameter of the interior space of the piston.

10. The hydraulic valve according to claim 9, wherein a portion of the fixation element which is provided for limiting a movement of the check valve has a partial height which is less than the height of the first portion.

11. The hydraulic valve according to claim 1, wherein the piston includes a flow out channel to establish a flow connection between the first operating connection, the second operating connection and a third connection opening provided in the housing, and wherein the third connection opening is flow connectable with the tank connection of the hydraulic valve.

12. The hydraulic valve according to claim 1, wherein the housing includes an flow out channel to establish a flow connection between the first operating connection, the second operating connection and the third connection opening provided in the housing, and wherein the third connection opening is flow connectable with the tank connection of the hydraulic valve.

13. The hydraulic valve according to claim 12, wherein the supply connection is arranged at an end of the tubular housing, and wherein the housing is configured tubular.

14. The hydraulic valve according to claim 1, wherein the hydraulic valve is configured as a central valve.

* * * * *